US009423753B1

(12) United States Patent
Sonoda

(10) Patent No.: US 9,423,753 B1
(45) Date of Patent: Aug. 23, 2016

(54) IMAGE FORMING APPARATUS

(71) Applicant: Oki Data Corporation, Tokyo (JP)

(72) Inventor: Masahiro Sonoda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/002,249

(22) Filed: Jan. 20, 2016

(30) Foreign Application Priority Data

Feb. 27, 2015 (JP) ..... 2015-038215

(51) Int. Cl.
*G03G 15/00* (2006.01)

(52) U.S. Cl.
CPC ..... *G03G 15/556* (2013.01); *G03G 15/5041* (2013.01)

(58) Field of Classification Search
CPC ..... G03G 15/556; G03G 15/5041
USPC ..... 399/49, 72
See application file for complete search history.

(56) References Cited

U.S. PATENT DOCUMENTS

2011/0123209 A1* 5/2011 Akita ..... G03G 15/0131 399/49

FOREIGN PATENT DOCUMENTS

JP 2004-258281 A 9/2004

* cited by examiner

*Primary Examiner* — Hoang Ngo
(74) *Attorney, Agent, or Firm* — Muncy, Geissler, Olds & Lowe, P.C.

(57) ABSTRACT

An image forming apparatus includes a density detection part and a control part to correct a density of developer image. The control part causes the density detection part to detect a density of first developer image and second developer image to obtain a first density detection result, and to detect a second density detection result that is another density detection result, and afterwards computes a first density comparison value by comparing the first density detection result with the second density detection result and corrects the density of the first developer image by subtracting the first density comparison value from the first density detection result.

11 Claims, 14 Drawing Sheets

IMAGE FORMING APPARATUS

CROSS REFERENCE TO RELATED APPLICATIONS

This application claims priority under 35 USC 119 to Japanese Patent Application No. 2015-038215 filed on Feb. 27, 2015, the entire contents which are incorporated herein by reference.

TECHNICAL FIELD

This invention relates to an image forming apparatus that forms (prints) image data on a print medium.

BACKGROUND

Conventionally, in the image forming apparatus according to Patent Document 1 for example, in order to prevent change in image density due to change with time of a developer (hereafter called "toner"), changes of the development characteristics due to the environment, etc., density detection patterns of low duty density, medium duty density, and high duty density are printed on a transfer belt for carrying the print medium. Then, by detecting the density detection patterns by a density detection part and correcting the density values of these detected density detection patterns, the image density is appropriately adjusted.

RELATED ART

[Patent Document 1] Unexamined Japanese Patent Application 2004-258281

However, in a conventional image forming apparatus, the following problems existed due to the influences of fog occurrences. Here, fog denotes a toner that is charged oppositely to the normally-charged toner or a toner that is little charged.

If a special color toner having a high fog frequency (for example, white (hereafter called "W") toner; W toner contains a large amount of metal oxides having a low resistance as the toner components causing poor chargeability and thus easily develops fog) is used, the fog toner adheres to the density detection patterns of the other color toners on the transfer belt, disabling appropriate density adjustment. Thereby, when printing in a 5-color mode including a special color (W) along with yellow (hereafter called "Y"), magenta (hereafter called "M"), cyan (hereafter called "M"), and black (hereafter called "K") and a 4-color mode of YMCK colors only, the densities of the color image commonly used by the 5-color mode and the 4-color mode would become different.

SUMMARY

An image forming apparatus disclosed in the specification includes: a first image forming unit that forms a first developer image with a first developer, a second image forming unit that forms a second developer image with a second developer that contains a larger amount of metal oxides having a low resistance than the first developer contains, a transfer part that contacts with the first image forming unit and the second image forming unit and transfers the first developer image and the second developer image to a transfer medium, a disjunction mechanism that moves the second image forming unit to realize a first state and a second state, the first state where both the first image forming unit and the second image forming unit contact with the transfer part and the second state where the second image forming unit separates from the transfer part and the first image forming unit contacts with the transfer part, a density detection part that detects densities of the first developer image and the second developer image transferred to the transfer medium, and a control part that controls operations of the first image forming unit, the second image forming unit, the transfer part, the disjunction mechanism, and the density detection part.

The control part controls an operation of the density detection part to cause the density detection part to detect the density of the first developer image among the first developer image and the second developer image transferred to the transfer medium in the first state to obtain a first density detection result, and to detect the density of the first developer image transferred to the transfer medium in the second state to obtain a second density detection result that is the density detection result, and afterwards computes a first density comparison value obtained by comparing the first density detection result with the second density detection result and corrects the density of the first developer image by subtracting the first density comparison value from the first density detection result.

According to the image forming apparatus of this invention, multiple density correction modes are provided, and density correction is controlled using density difference values resulting from density detections in these density correction modes. Thereby, an appropriate density adjustment becomes possible accounting for the influences of fog toners.

DETAILED DESCRIPTIONS OF THE EMBODIMENTS

Embodiments of this invention will become clear when the following explanations on the preferred embodiments are read referring to the attached drawings. Note that the drawings are only for the explanations and not for limiting the scope of this invention.

Embodiment 1

Configuration of Embodiment 1

Figure 2:
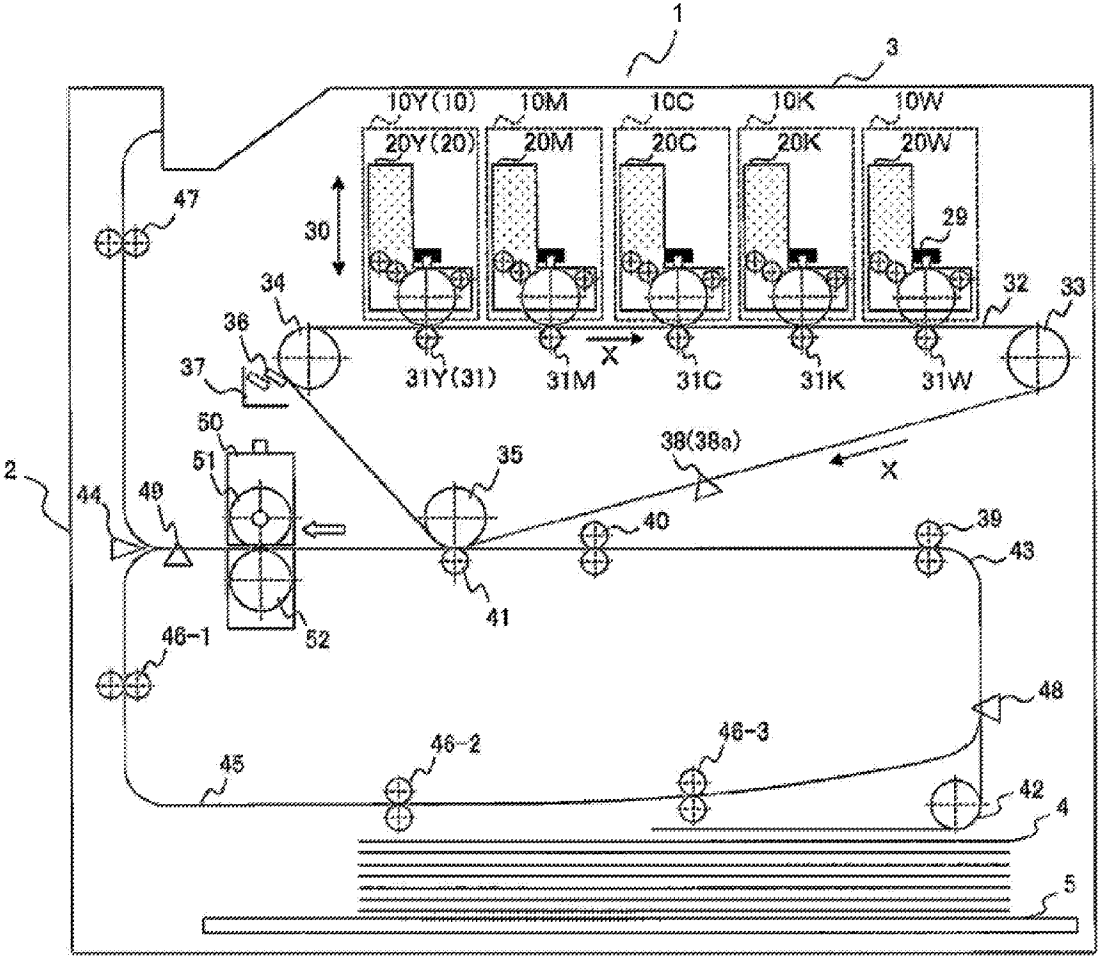
FIG. 2 is an overall structural drawing showing an image forming apparatus in Embodiment 1 of this invention.

FIG. 2 is an overall structural drawing showing an image forming apparatus in Embodiment 1 of this invention.

The image forming apparatus 1 of this Embodiment 1 is, for example, a color electrophotographic printer using an intermediate transfer system, and is provided with a chassis 2 that contains the whole apparatus, and an open/close cover 3 that opens/closes the upper part of this chassis 2. Removably set in the lower part inside the chassis 2 is, for example, a medium cassette 5 that contains a print medium 4 such as sheets of paper before printing. Disposed in the upper part inside the chassis 2 are multiple stations 10 for setting image forming units (hereafter called "ID units"). The multiple stations 10 are, for example, a Y-color station 10Y, an M-color station 10M, a C-color station 10C, a K-color station 10K, and a W-color station 10W, and these are disposed in the carrying direction X of the print medium 4 shown with an arrow in FIG. 2.

Detachably set in these individual stations 10 (=10Y, 10M, 10C, 10K, and 10W) by opening the open/close cover 3 are 5-color ID units 20 that are image drum units as development units corresponding to 5-color toners (hereafter called "color toners") as Y, M, C, K, and W color developers. Provided as the 5-color ID units 20 are, for example, a Y-color ID unit 20Y, an M-color ID unit 20M, a C-color ID unit 20C, and a K-color ID unit 20K as first image forming units, and a W-color ID unit 20W as a second image forming unit. Provided in the individual-color ID units 20 are individual-color up-down mechanisms 30 as disjunction mechanisms.

The individual-color up-down mechanisms 30 move up/down the individual-color ID units 20 and have them contact with or separate from individual-color primary transfer rollers 31 as transfer parts arranged below it. Provided as the individual-color primary transfer rollers 31 are, for example, a Y-color primary transfer roller 31Y, an M-color primary transfer roller 31M, a C-color primary transfer roller 31C, a K-color primary transfer roller 31K, and a W-color primary transfer roller 31W.

Set inside the individual-color stations 10 are individual-color light emitting diode (hereafter called "LED") heads 29 as exposure part that form electrostatic latent images by irradiating the individual-color ID units 20 with light.

Nipped (or sandwiched) between the lower parts of the individual-color ID units 20 and the individual-color primary transfer rollers 31 is an intermediate transfer belt 32 as a transfer medium. The intermediate transfer belt 32 has a seamless and endless shape and is formed of, for example, a high-resistance semiconductive plastic film. The intermediate transfer belt 32 is looped over a drive roller 33, a belt driven roller 34, and a secondary transfer backup roller 35, and rotates by the drive roller 33. The upper face part of the intermediate transfer belt 32 is movably disposed between the individual-color primary transfer rollers 31 and the individual-color ID units 20. Toner images formed in the individual-color ID units 20 are tentatively transferred to the intermediate transfer belt 32 in this configuration.

Disposed in contact with the intermediate transfer belt 32 is a cleaning blade 36 in a position opposing the belt driven roller 34. Adhering materials such as toners scraped off by the cleaning blade 36 are contained in a cleaner container 37 in this configuration. Arranged in the vicinity of the intermediate transfer belt 32 is a density detection part 38. The density detection part 38 detects and obtains the results of detecting the densities of the YMCKW density detection patterns created on the intermediate transfer belt 32, and is configured of, for example, an optical sensor comprising a light emitting part and a light receiving part arranged opposing the intermediate transfer belt 32. Provided in the density detection part 38 is a shutter mechanism 38*a*, and adherence of dirt such as toners can be prevented by shutting the shutter mechanism 38*a* except for the density detection time.

Arranged in the lower side of the secondary transfer backup roller 35 are a registration roller 39, a carrying roller 40, a secondary transfer roller 41 as the transfer medium, a hopping roller 42, a carrying path 43, a carrying separator 44, a recarrying path 45, multiple recarrying rollers 46-1 through 46-3, a writing sensor 48, an ejection sensor 49, and a fuser 50. Further, arranged in the downstream side of the carrying separator 44 is an ejection roller 47.

The secondary roller 41 is disposed opposing the secondary transfer backup roller 35. The toner images tentatively transferred to the intermediate transfer belt 32 are transferred by the secondary transfer roller 41 to the print medium 4. The print medium 4 is extracted one piece at a time by the hopping roller 42 and sent to the carrying path 43. The print medium 4 sent to the carrying path 43 is carried by the registration roller 39 and the carrying roller 40 to a nip part of the intermediate transfer belt 32 and the secondary transfer roller 41 at a specified timing. Disposed in the downstream side of the secondary transfer roller 41 is the fuser 50.

The fuser 50 comprises a heat roller 51 and a pressure roller 52 that are in contact with each other, and fuses the toner images adhering to the print medium 4 by applying heat and a pressure by the heat roller 51 and the pressure roller 52. The print medium 4 after fusing is either carried to the recarrying path 45 or ejected to the outside of the apparatus through the ejection roller 47 by a selection operation of the carrying separator 44 driven by a drive part in this configuration. The print medium 4 on the recarrying path 45 is carried by the multiple recarrying rollers 46-1 through 46-3 and merges into the carrying path 43. The writing sensor 48 and the ejection sensor 49 disposed in the vicinity of the carrying path 43 are mechanical sensors for detecting the passage of the print medium 4 and operate every time the print medium 4 passes.

Figure 3:
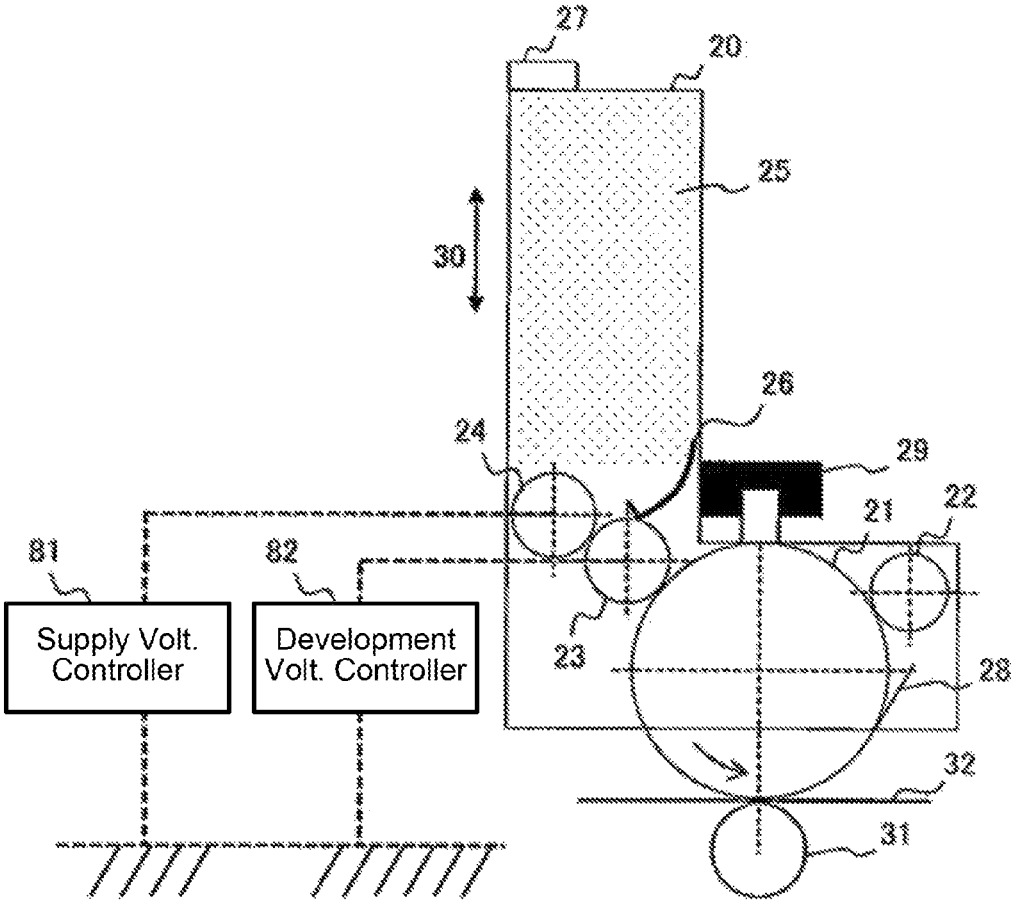
FIG. 3 is an enlarged view showing the structure of an individual-color ID unit 20 in FIG. 2.

FIG. 3 is an enlarged view showing the structure of an individual-color ID unit 20 in FIG. 2. The individual-color ID units 20 (=20Y, 20M, 20C, 20K, and 20W) have identical structures. Each of the ID units 20 comprises a photosensitive drum 21 as an image carrying part that forms an electrophotographic latent image on its surface, and contacting with the outer-circumference face of this photosensitive drum 21 are a charging roller 22 as a charging part and a development roller 23 as a development part. The charging roller 22 uniformly charges the photosensitive drum 21. Disposed in the vicinity of the photosensitive drum 21 is an LED head 29 as an exposure part. The LED head 29 irradiates the surface of the charged photosensitive drum 21 with light to form an electrophotographic latent image. The development roller 23 develops the electrophotographic latent image formed on the photosensitive drum 21 to form a toner image.

Contacting with the outer-circumference face of the development roller 23 are a supply roller 24 as a toner supply part and a toner regulatory blade 26. The supply roller 24 supplies a toner ejected from a toner cartridge 25 that retains the toner to the development roller 23 and frictionally charges the toner. The toner cartridge 25 is part of the ID unit 20 and is detachably attached to the development roller 23. The toner regulatory blade 26 adjusts the film thickness and the amount of charge of the toner adhering to the development roller 23. Attached to the vicinity of the toner cartridge 25 is an RFID (Radio Frequency Identifier) 27 as a memory part. The RFID 27 exchanges information taken from an integrated circuit tag (IC tag), where information such as the toner color and ship-to destination is written, through short-distance wireless communication using an electromagnetic field or a radio wave. This RFID 27 is configured of, for example, an antenna and a memory element such as EPROM (Erasable Programmable Read Only Memory). Contacting with the outer-circumference face of the photosensitive drum 21 is a cleaning blade 28. The cleaning blade 28 removes a toner remaining on the surface of the photosensitive drum 21.

Applied to the development roller 23 is a development voltage from a development voltage controller 82. Also applied to the supply roller 24 is a supply voltage from a supply voltage controller 81. Further, applied to the primary transfer roller 31 disposed in the vicinity of the photosensitive drum 21 is a transfer voltage. A color toner image formed on the photosensitive drum 21 is transferred to the intermediate transfer belt 32 by the transfer voltage applied to the primary transfer roller 31.

Figure 1:
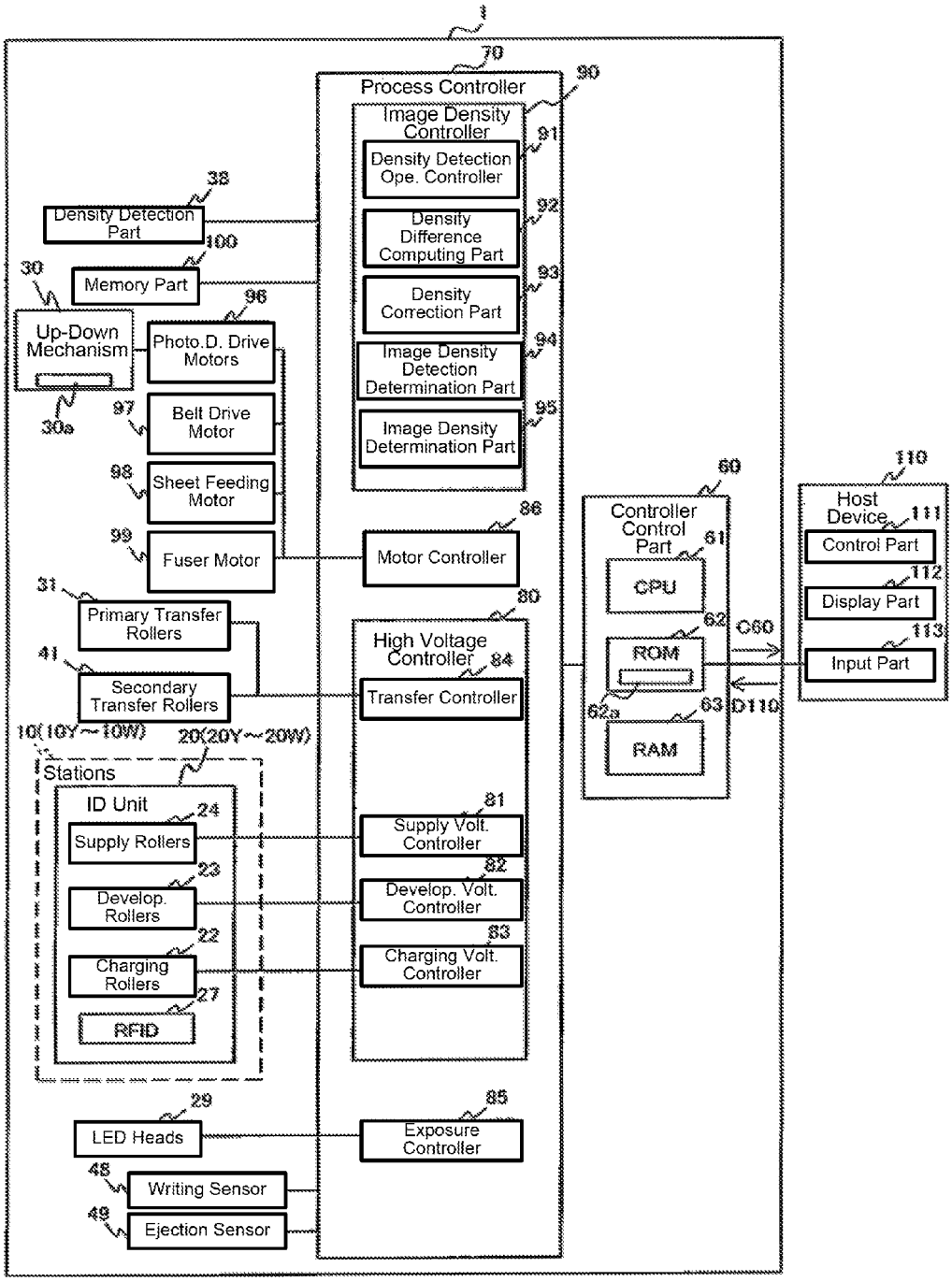
FIG. 1 is a configuration block diagram showing a control circuit in the image forming apparatus 1 in FIG. 2.

FIG. 1 is a configuration block diagram showing a control circuit in the image forming apparatus 1 in FIG. 2. Based on print data D110 given from a host device 110, the image forming apparatus 1 performs a specified image processing (that is, a print process).

The host device 110 is configured of, for example, a personal computer (PC), comprises a control part 111 configured of a central processing unit (hereafter called "CPU") etc., and a display part 112, an input part 113, etc. controlled by this control part 111, and has a function to create the print data D110 etc. The created print data D110 are sent to the image forming apparatus 1 through an interface (hereafter called "I/F") such as Universal Serial Bus (USB) and Local Area Network (LAN). Also, the host device 110 receives an instruction C60 output from the image forming apparatus 1 through the I/F. The display part 112 is configured of a liquid crystal display etc. for displaying a print image created by an application executed by the control part 111 and displaying the instruction C60 output from the image forming apparatus 1. The input part 113 creates an image of the print data D110 through an application etc. and is configured of a keyboard, a mouse, etc. for inputting a response to the instruction C60 output from the image forming apparatus 1.

The image forming apparatus 1 comprises a controller control part 60, and a process controller 70 as a control part connected to this controller control part 60. The controller control part 60 comprises a CPU 61, a nonvolatile memory (for example, read-only memory, hereafter called "ROM") 62, and a volatile memory (for example, random access memory, hereafter called "RAM") 63, etc., and these components are mutually connected via an internal bus. The CPU 61 has a function to control the RAM 63 and the process controller 70 by following a print processing program 62*a* stored in the ROM 62. The ROM 62 is a region for storing the print processing program 62*a* and is a memory that can retain data even if the power supply to the image forming apparatus 1 is cut off. The RAM 63 is a memory that stores the print data D110 input from the host device 110, whose data are erased if the power supply to the image forming apparatus 1 is cut off.

The process controller 70 comprises a high voltage controller 80, an exposure controller 85, a motor controller 86, and an image density controller 90, and is for properly controlling the carriage of the print medium 4 and the print processes such as charging, development, transfer, and fusing.

The high voltage controller 80 is for properly controlling voltages applied to various kinds of rollers for transferring to the print medium 4, and comprises the supply voltage controller 81 as a supply voltage application part, the development voltage controller 82, a charging voltage controller 83, and a transfer controller 84. The supply voltage controller 81 is for applying a supply voltage to the supply rollers 24 inside the individual color ID units 20. The development voltage controller 82 is for applying the development voltage to the development rollers 23 inside the individual-color ID units 20. The charging voltage controller 83 is for applying a charging voltage to the charging rollers 22 inside the individual-color ID units 20. Further, the transfer controller 84 is for applying a primary transfer voltage to the individual-color primary transfer rollers 31 (=31Y, 31M, 31C, 31K, and 31W) and applying a secondary transfer voltage to the secondary transfer roller 41 in order to transfer color toner images carried by the intermediate transfer belt 32 to the print medium 4.

The exposure controller 85 is for controlling the exposure of the individual-color LED heads 29. The motor controller 86 is for controlling and rotationally driving the individual motors inside the image forming apparatus 1. Specifically, the motor controller 86 has a function to control the operations of photosensitive drum drive motors 96 (or Photo.D. Drive Moter) that drive the individual-color photosensitive drums 21, a belt drive motor 97 that drives the intermediate transfer belt 32, a sheet feeding motor 98 that drives the hopping roller 42, a fuser motor 99 that drives the fuser 50, and other unshown motors (for example, motors for the registration roller 39, the carrying roller 40, the carrying separator 44, and the ejection roller 47).

The photosensitive drum drive motors 96 are provided by individual colors, and the up-down mechanisms 30 are connected to them. Each of the up-down mechanisms 30 is a mechanism that drives up or down an individual-color ID unit and is configured of a solenoid, a drive gear, and an up-down sensor 30*a* comprising an optical sensor, etc. that are not shown. In this configuration, the driving force of each of the photosensitive drum drive motors 96 is switched by the solenoid and the drive gear to the up-down drive of the ID unit 20. The up-down sensor 30*a* is a sensor for detecting whether the ID unit 20 is in the up state or the down state.

The image density controller 90 is a control part for making the image density at the time of printing appropriate, and is configured of a density detection operation controller 91 as a density detection operation control part, a density difference computing part 92 as a density difference computing part, a density correction part 9 as a density correction part, an image density detection determination part 94 as a first determination part, and an image density determination part 95 as a second determination part.

The density detection operation controller 91 controls the density detection operations in multiple states of the individual-color ID units 20 (=20Y, 20M, 20C, 20K, and 20W) created by the up-down mechanisms 30. The density difference computing part 92 computes differences in image density detected by multiple density detection operations. The density correction part 93 corrects the image density at the time of printing based on the image density detected by the density detection operation controller 91 and the computation result by the density difference computing part 92. The image density detection determination part 94 determines whether the density detection part 38 has already detected the first image density IG1 (that is, the densities of YMCK among YMCKW in the density detection patterns detected by the density detection part 38) last time. The image density determination part 95 determines the image density detection result in a specific state controlled by the density detection operation controller 91.

The term, "last time," of this invention means any operation that were previously conducted, particularly the most recently conducted. The term, "this time," means any operation that is currently running or to run. For example, when conducting density detections three times, the first detection and its result are the last time detection and the result with respect to the second time. The second detection and its result are the last time detection with respect to the third time detection.

Connected to the image density controller 90 is the density detection part 38. Further, connected to the process controller 70 is a memory part 100. The memory part 100 has a function to store and update multiple image density detection results and the computation results of the density difference computing part 92.

(Basic Operations of the Image Forming Apparatus in Embodiment 1)

Upon receiving the print instruction from the host device 110, the image forming apparatus 1 has the CPU 61 control individual operations to execute the print operation based on the print processing program 62*a* stored in the ROM 62 inside the controller control part 60.

First, actuators of the motors 96 through 99 etc. are controlled by the motor controller 86 inside the process controller 70, and the hopping roller 42 is mechanically driven to carry the print medium 4 from the medium cassette 5 to the carrying path 43. The drive timing of the hopping roller 42 is determined by the position of the carried print medium 4 being detected by running sensors such as the writing sensor 48. Once the leading edge of the print medium 4 is detected by the writing sensor 48, the print process operation is started.

By the high voltage controller 80 inside the process controller 70, the charging voltage controller 83 is controlled to apply a charging voltage that corresponds to desired conditions to the individual-color charging rollers 22. Thereby, the surfaces of the individual-color photosensitive drums 21 are uniformly charged. Then, according to the print data D110 from the host device 110, the surfaces of the individual-color photosensitive drums 21 are exposed with recording light radiated from the individual-color LED heads 29. On the irradiated surfaces of the individual-color photosensitive drums 21, the print data D110 are formed as electrostatic latent images. These electrostatic latent images are visualized with toners on the development rollers 23 by the supply voltage controller 81 inside the high voltage controller 80 applying the supply voltage to the individual-color supply rollers 24, and the development voltage controller 82 applying the development voltage to the individual-color development rollers 23.

Next, by the transfer controller 84 inside the high voltage controller 80, a desired transfer voltage is applied to the individual-color primary transfer rollers 31 to transfer the above-mentioned visualized individual-color toner images to the intermediate transfer belt 32. Because the intermediate transfer belt 32 is rotationally driven in the downstream direction by the belt drive motor 97 being controlled by the motor controller 86, the transferred individual-color toner images are carried sequentially in the downstream direction. Then, when the toner images are carried up to the position of the secondary transfer roller 41, a desired transfer voltage is applied to the secondary transfer roller 41, and the individual-color toner images are transferred onto the print medium 4. If the print data D110 are color image data, the print process operations for individual YMCKW colors are executed, and a color image is formed on the surface of the print medium 4.

The print medium 4 with the image formed is carried to the fuser 50 and fused by heat and a pressure. The fuser 50 comprises a heat roller 51 having a heat generation body such as a heater built-in and is controlled in such a manner that fusing is performed at an appropriate temperature by detecting the fusing temperature using a temperature detection element such as a thermistor. The print medium 4 that went through the print process passes the ejection sensor 49 and is ejected to the outside of the image forming apparatus 1 via the carrying separator 44 and the ejection roller 47.

(Image Density Correction of Embodiment 1)

Other than the above-mentioned basic operations, the image forming apparatus 1 performs a density correction in such a manner that the image density on the print medium 4 becomes appropriate. This density correction is explained below.

Figure 4A:
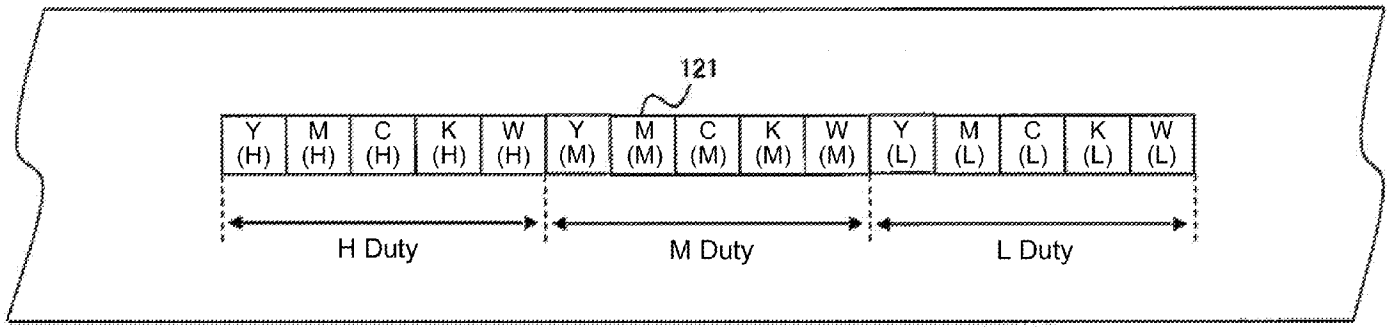
FIGS. 4A and 4B are illustrations showing density detection patterns on an intermediate transfer belt.
Figure 4B:
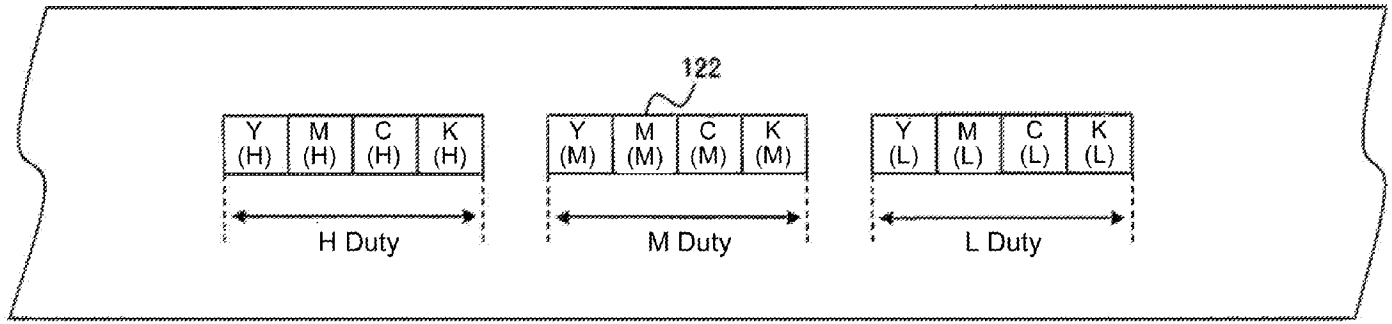

FIGS. 4A and 4B are illustrations showing density detection patterns on the intermediate transfer belt, where FIG. 4A is a drawing of density detection patterns 121 for 5 colors of YMCKW, and FIG. 4B is a drawing of density detection patterns 122 for 4 colors of YMCK.

The density detection patterns 121 and 122 are configured by sequentially disposing three patterns (high duty density (H Duty), medium duty density (M Duty), and low duty density (L Duty)) along the carrying direction X of the intermediate transfer belt 32 indicated by an arrow to allow adjusting the densities of intermediate colors. In the case of the 5-color density detection patterns 121, high duty density YMCKW, medium duty density YMCKW, and low duty density YMCKW are sequentially disposed next to one another along the carrying direction X. In the case of the 4-color density detection patterns 122, high duty density YMCK, medium duty density YMCK, and low duty density YMCK are sequentially disposed along the carrying direction X, with specified intervals.

Here, the low duty density denotes a duty of 30% or lower, the medium duty density 30-80%, and the high duty density 80% or higher, which has a relationship of low duty <medium duty <high duty.

At the time of image density detection, the YMCKW density detection patterns 121 (or the YMCK density detection patterns 122) are transferred (printed) on the intermediate transfer belt 32 without carrying the print medium 4. That is, as shown in FIGS. 4A and 4B, low duty density WKCMY, medium duty density WKCMY, and high duty density WKCMY (or low duty density KCMY, medium duty density KCMY, and high duty density KCMY) are sequentially printed in the reverse direction of the carrying direction X. By controlling the belt drive motor 97 by the motor controller 86, the intermediate transfer belt 32 is driven in the carrying direction X. By driving the intermediate transfer belt 32, the printed density detection patterns 121 (or density detection patterns 122) are sequentially moved to the position of the density detection part 38. The density detection part 38 detects the individual-color densities of the density detection patterns 121 (or density detection patterns 122) that move up in order. The detected individual-color densities in the density detection patterns 121 and 122 are stored in the memory part 100 by the control of the process controller 70.

Figure 5:
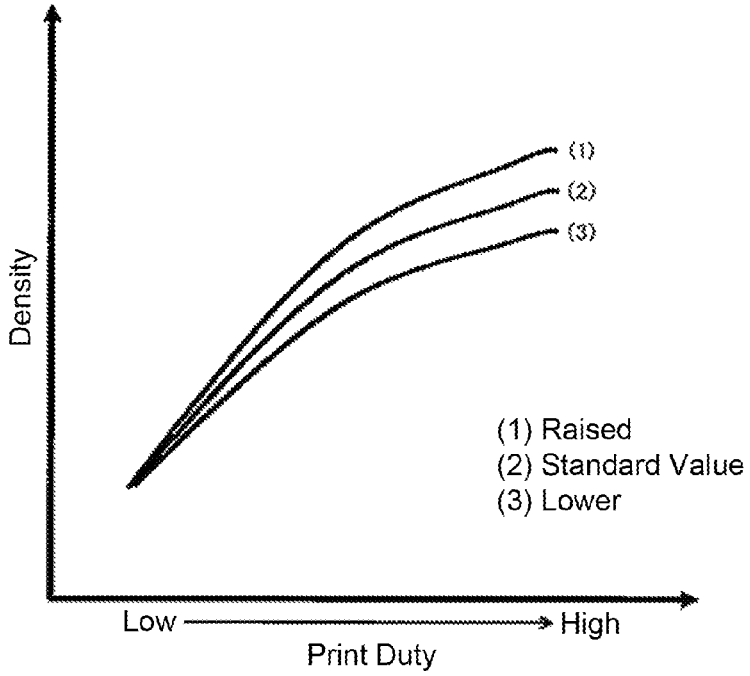
FIG. 5 is a plot showing the print duty-density characteristics when a development voltage applied to a development roller 23 varies.

FIG. 5 is a plot showing the print duty-density characteristics when the development voltage applied to the development roller 23 varies. The horizontal axis in FIG. 5 is the print duty, and the vertical axis is the density.

In FIG. 5, a curve (1) is the characteristic when the development voltage is raised, a curve (2) is the characteristic when the development voltage is set to the standard value, and a curve (3) is the characteristic when the development voltage is lowered. Based on the curves (1), (2), and (3), it is evident that the image density varies according to the development voltage as the image becomes denser when the development voltage is raised, and thinner when the development voltage is lowered.

Figure 6:
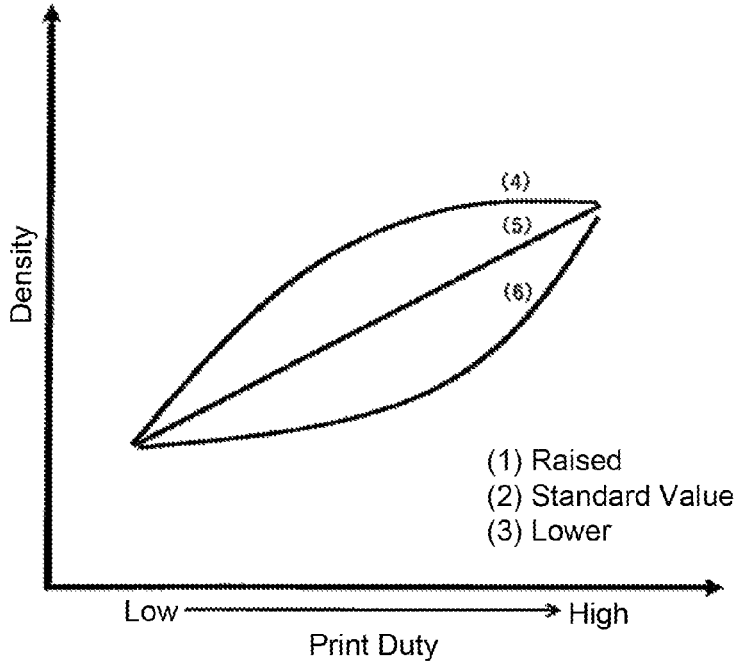
FIG. 6 is a plot showing the print duty-density characteristics when the light amount of an LED head 29 varies.

FIG. 6 is a plot showing the print duty-density characteristics when the light amount of the LED head 29 varies. The horizontal axis in FIG. 6 is the print duty, and the vertical axis is the density.

In FIG. 6, a curve (4) is the characteristic when the light amount is increased, a curve (5) is the characteristic when the light amount is set to the standard value, and further a curve (6) is the characteristic when the light amount is decreased. Based on the curves (4), (5), and (6), it is evident that the image density varies according to the light amount as the image becomes denser when the light amount is increased, and thinner when the light amount is decreased.

Therefore, an image density correction is performed by substituting the individual-color low duty, medium duty, and high duty densities detected by the density detection part 38 in the following Eqs. (11) and (12) and computing the corrected values of the light amount and the development voltage, respectively. These values obtained by the followings are used for feedbacks to perform the corrections.

$$(\text{Light amount})=[(\text{1st Sec.})+(\text{2nd Sec.})]/2 \qquad \text{(Eq. 11)}$$

$$(\text{1st Sec.}) = \frac{\left\{(\text{High duty detected value}) \times \left(\frac{\text{Low duty target value}}{\text{High duty target value}}\right) - (\text{Low duty detected value})\right\}}{K1}$$

$$(\text{2nd Sec.}) = \frac{\left\{(\text{High duty detected value}) \times \left(\frac{\text{Medium duty target value}}{\text{High duty target value}}\right) - (\text{Medium duty detected value})\right\}}{K2}$$

$$(\text{Development voltage})=[(\text{3rd Sec.})+(\text{4th Sec.})+(\text{5th Sec.})]/3 \qquad \text{(Eq. 12)}$$

$$(\text{3rd Sec.}) = \frac{\{(\text{Low duty detected value}) - ((\text{Low Duty detected value}) + (\text{Changed light amount}) \times K1)\}}{K3}$$

$$(\text{4th Sec.}) = \frac{\{(\text{Medium duty detected value}) - ((\text{Medium duty detected value}) + (\text{Changed light amount}) \times K2)\}}{K4}$$

$$(\text{5th Sec.}) = \frac{\{(\text{High duty target value}) - (\text{High duty detected value})\}}{K5}$$

where

K1: Changed amount of low duty density per unit changed light amount

K2: Changed amount of medium duty density per unit changed light amount

K3: Changed amount of low duty density per unit change of the development voltage K4: Changed amount of medium duty density per unit change of the development voltage K5: Changed amount of high duty density per unit change of the development voltage Here, the 5-color image forming apparatus 1 that supports YMCK colors and a special color W is provided with an operation mode to allow printing with 5 colors of YMCKW and an operation mode to allow printing with 4 colors of YMCK. This is because of a consideration for users who do not frequently use the special color W.

By using a special-color toner (for example, the special-color W toner), there arises the following concern. An issue in using the special-color W toner is fog. The occurrence of this fog toner is noticeable with the W toner that contains a large amount of metal oxides having low resistance.

Figure 7:
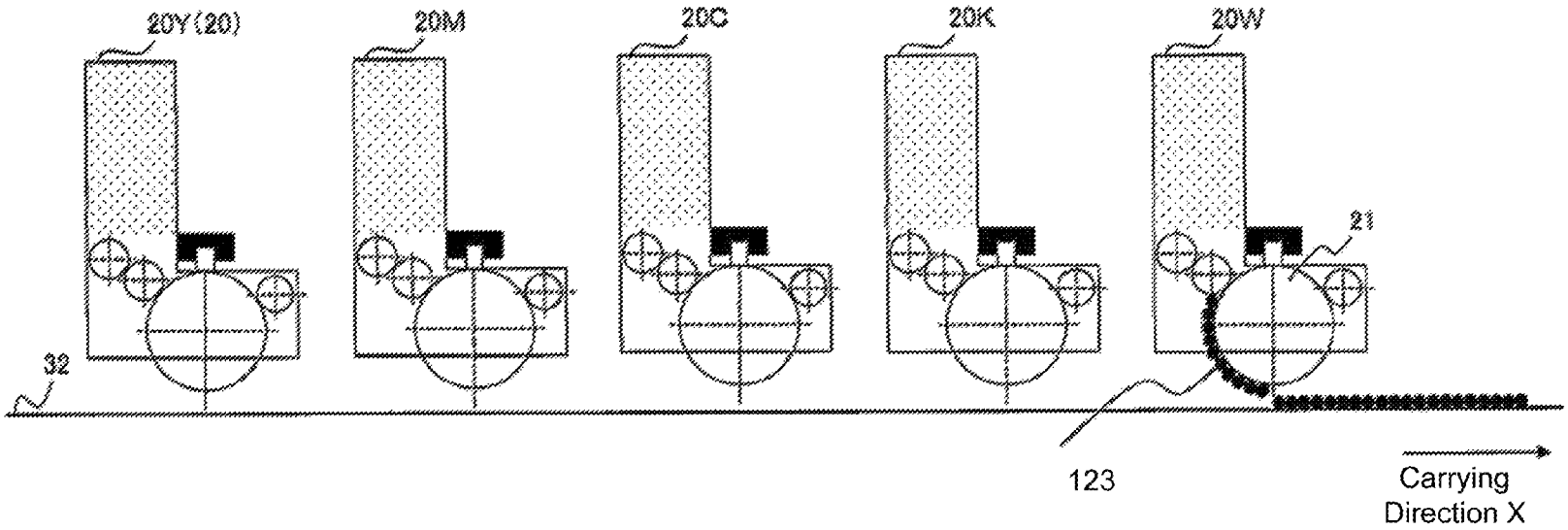
FIG. 7 is an illustration showing the transition of a W fog toner (the W-color ID unit 20W is in the most downstream side).

FIG. 7 is an illustration showing the transition of the W fog toner (the W-color ID unit 20W is in the most downstream side).

In the carrying direction X of the intermediate transfer belt 32, if the W-color ID unit 20W is disposed in the most downstream, the W fog toner 123 on the photosensitive drum 21 would move onto the intermediate transfer belt 32. As mentioned above, if the density detection patterns 121 are created on the intermediate transfer belt 32 in this state, the W fog toner 123 would ride on the density detection patterns created by the ID units 20Y, 20M, 20C, and 20K in the upstream of the ID unit 20W.

Figure 8:
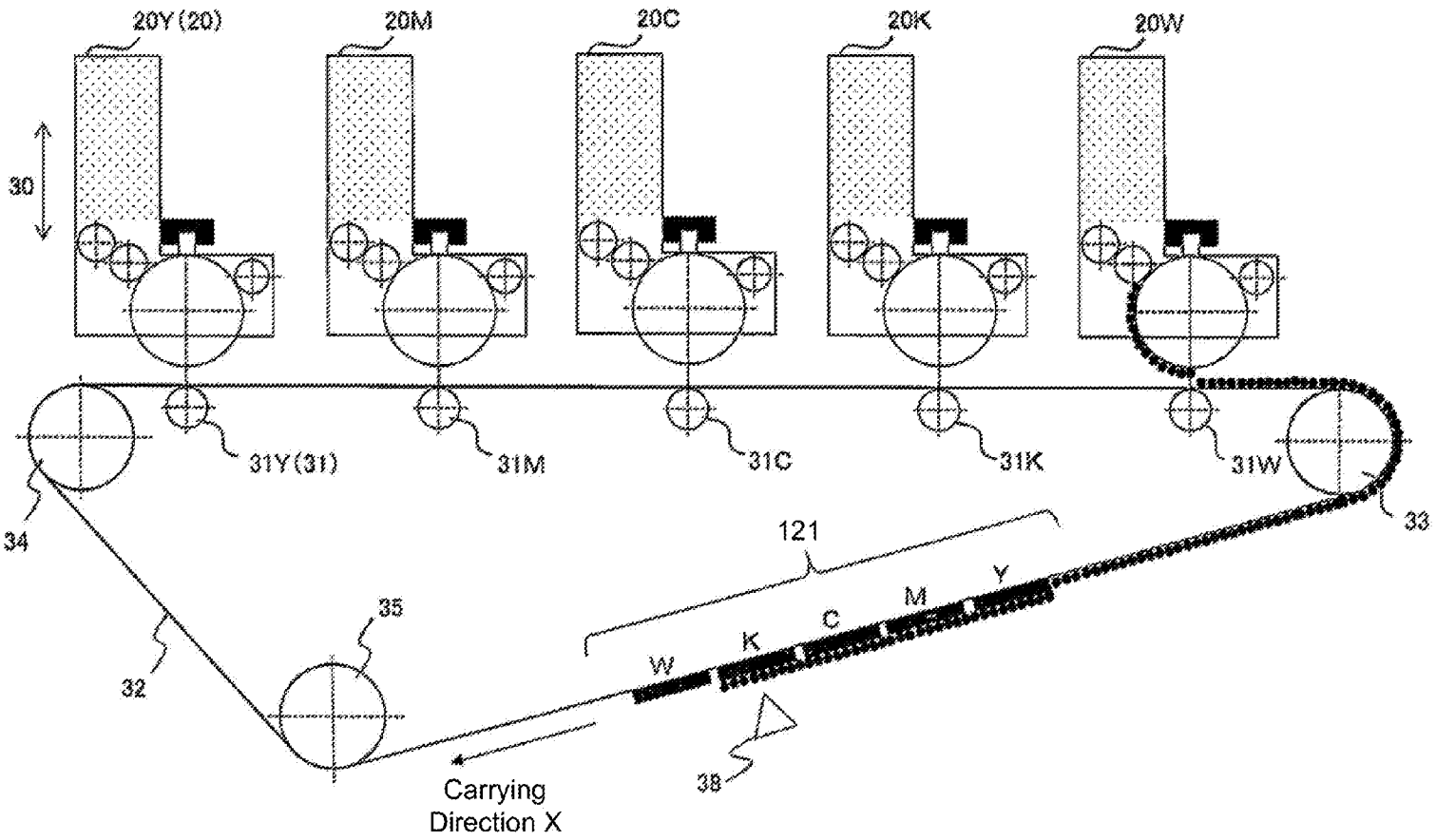
FIG. 8 is a main part structural drawing showing the image forming apparatus 1 in a first state ST1 (state with YMCKW down).
Figure 9:
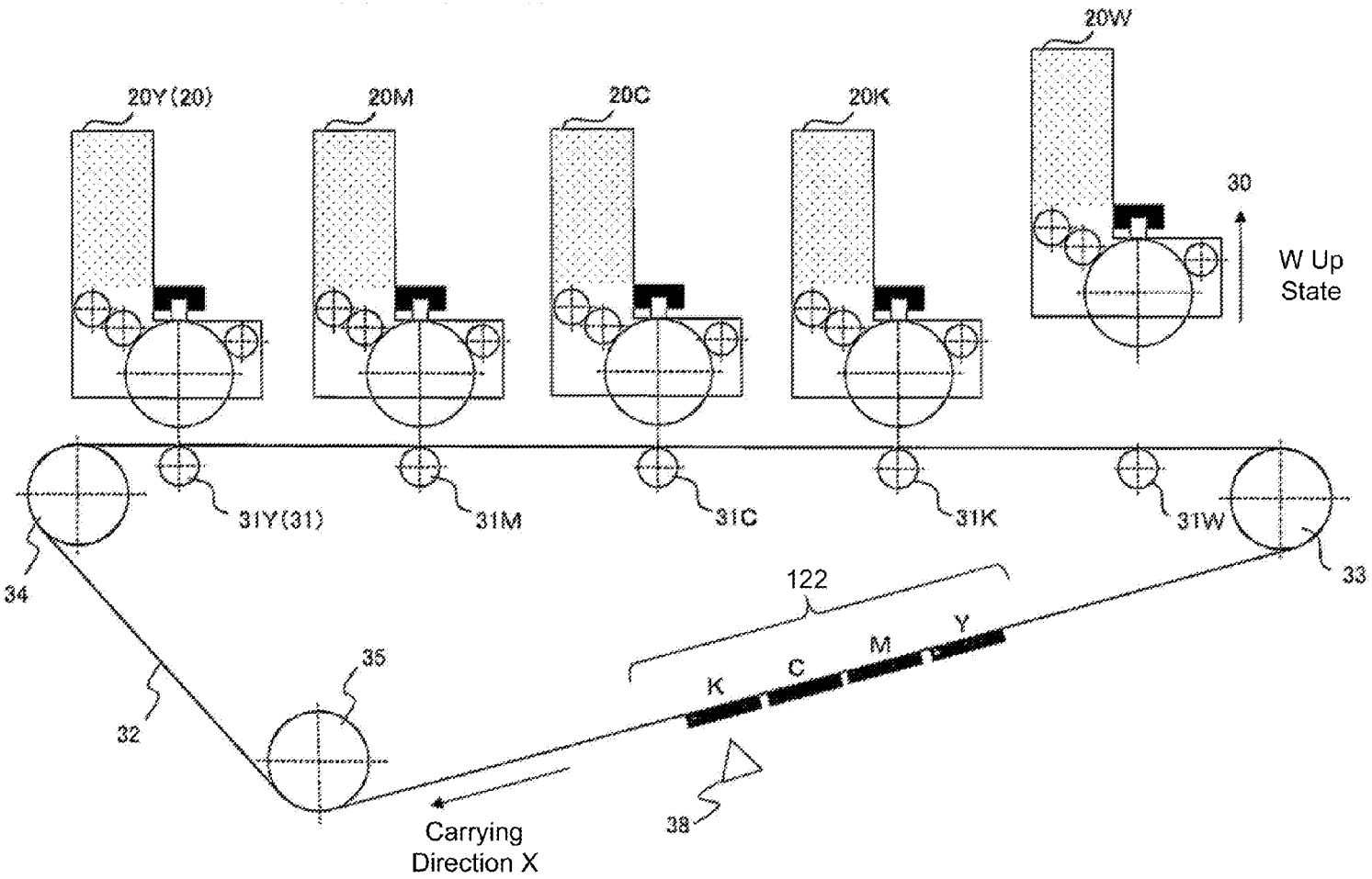
FIG. 9 is a main part structural drawing showing the image forming apparatus 1 in a second state ST2 (state with YMCK down and W up).

FIG. 8 is a main part structural drawing showing the image forming apparatus 1 in the first state ST1 (state with YMCKW down) where the W fog toner 123 is riding on the YMCK density detection patterns. FIG. 9 is a main part structural drawing showing the image forming apparatus 1 in the second state ST2 (state with YMCK down and W up) where the W fog toner 123 is not riding on the YMCK density detection patterns.

Figure 10:
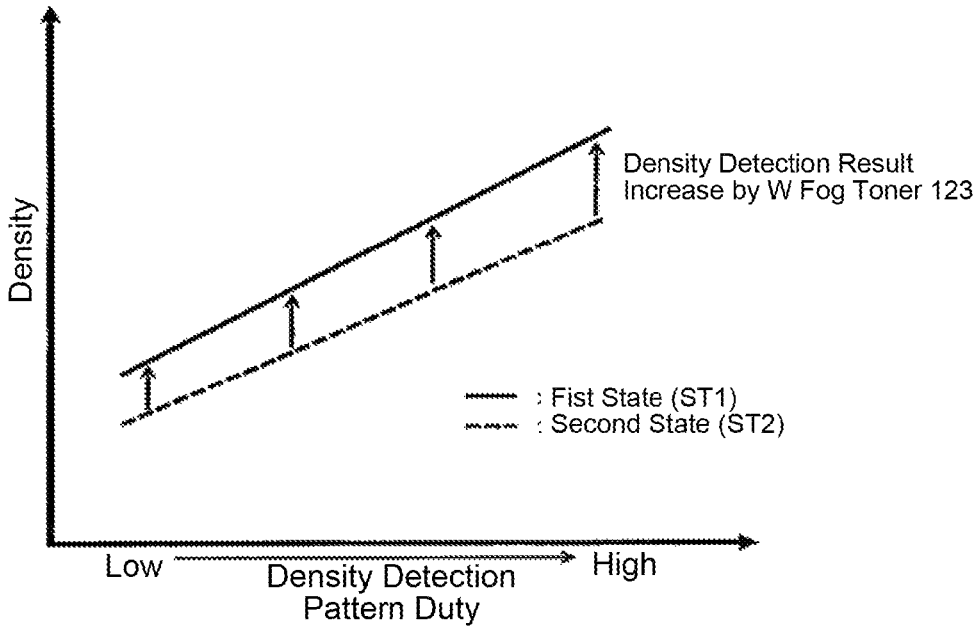
FIG. 10 is a plot showing the result of comparing the detection results of the image densities (for example, magenta densities) in the first state ST1 and the second state ST2 detected by a density detection part 38.

Further, FIG. 10 is a plot showing the result of comparing the detection results of the YMCK individual-color image densities (for example, M-color densities) in the first state ST1 and the second state ST2 detected by the density detection part 38. The horizontal axis in FIG. 10 is the density detection pattern duty, and the vertical axis is the density, where a solid line indicates the first state ST1, and a broken line the second state.

Shown in FIG. 8 are the density detection patterns 121 when the 5-color ID units 20Y, 20M, 20C, 20K, and 20W are in the down state (that is, the first state ST1) by the up-down mechanisms 30. Further, shown in FIG. 9 are the density detection patterns 122 when the 4-color ID units 20Y, 20M, 20C, and 20K are in the down state, and the W-color ID unit 20W is in the up state (that is, the second state ST2) by the up-down mechanisms 30.

As shown in FIG. 10, the image density is higher in the first state ST1 than in the second state ST2. That is, the color density has increased by the W fog toner 123 (or density detection result increases by W fog toner 123). It is evident that even if this value is applied to the above-mentioned Eqs. (11) and (12) to perform a density correction, the color YMCK densities between the first state ST1 and the second state ST2 do not match. In this case, there occurs a problem that the result of color printing in the YMCKW 5-color mode and the result of color printing in the YMCK 4-color mode differ in the image density.

In order to avoid this problem, the density detection operation is performed in multiple kinds of states by the density detection operation controller 91. One is the first state ST1 shown in FIG. 8 where all the 5-color ID units 20Y, 20M, 20C, 20K, and 20W are down, and another is the second state ST2 shown in FIG. 9 where only the 4-color ID units 20Y, 20M, 20C, and 20K are down (only the W-color ID unit 20W is up).

(Flow Charts of the Density Detection and Density Correction Operations in Embodiment 1)

Figure 11:
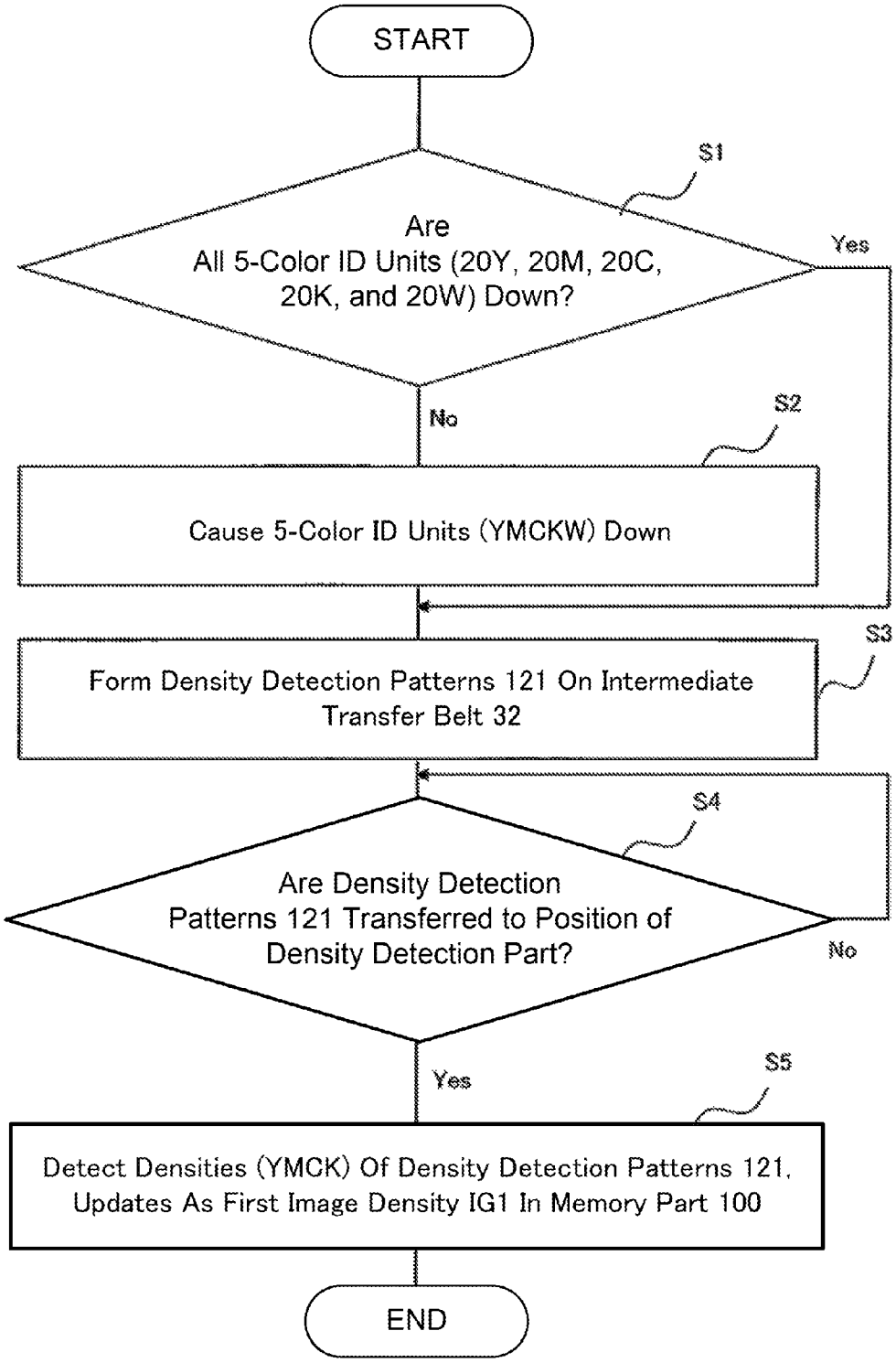
FIG. 11 is a flow chart showing a density detection operation in the first state ST1.

FIG. 11 is a flow chart showing the density detection operation in the first state ST1.

Once the density detection operation in the first state ST1 in FIG. 11 is started, in S1 the CPU 61 inside the controller control part 60 in FIG. 1 checks whether all the 5-color ID units 20Y, 20M, 20C, 20K, and 20W are down or not. Whether the ID units 20Y, 20M, 20C, 20K, and 20W are down or not is detectable by the up-down sensors 30*a* of the up-down mechanisms 30. If not all the colors are down (No), it proceeds to S2, and if all the colors are down (Yes), it proceeds to S3.

In S2, all the 5-color ID units 20Y, 20M, 20C, 20K, and 20W are moved down by controlling the up-down mechanisms 30 by the motor controller 86 inside the process controller 70 in FIG. 1 through the photosensitive drum drive motors 96, and it proceed to S3. In S3, once the CPU 61 confirms that all the colors are in the down state, the density detection patterns 121 are formed on the intermediate transfer belt 32 by the control of the process controller 70 in FIG. 1, and it proceeds to S4.

In S4, the belt drive motor 97 is controlled by the motor controller 86 inside the process controller 70 in FIG. 1 to carry the density detection patterns 121 to the position of the density detection part 38 controlled by the image density controller 90 inside the process controller 70. If the density detection patterns 121 have not been carried to the position of the density detection part 38 (No), the carriage is repeated, and if it is detected by the density detection part 38 that the density detection patterns 121 have been carried to the position of the density detection part 38 (Yes), it proceeds to S5.

In S5, the density detection part 38 detects the densities of individual colors of YMCK in the density detection patterns 121, updates the memory part 100 with the first density detection result that is this YMCK density detection result as the first image density IG1, and ends the density detection operation.

Besides, in the above-mentioned density detection part 38, the densities of individual colors of YMCKW in the density detection patterns 121 may be detected, and the density detection results of YMCK excluding W color may be used as the above-mentioned first density detection result.

Figure 12:
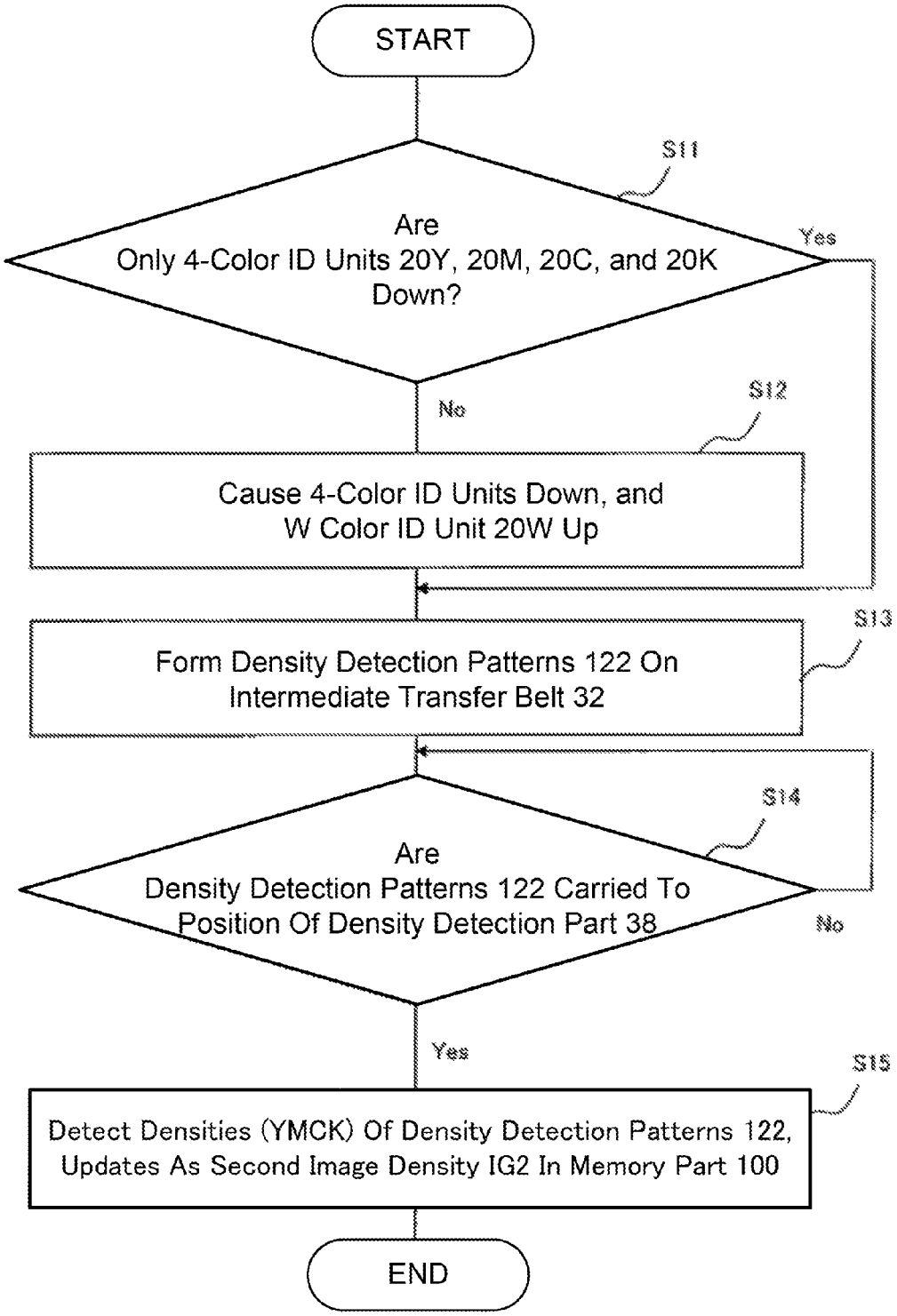
FIG. 12 is a flow chart showing a density detection operation in the second state ST2.

FIG. 12 is a flow chart showing a density detection operation in the second state ST2. Once the density detection operation in the second state ST2 in FIG. 12 is started, in S11 the CPU 61 inside the controller control part 60 in FIG. 1 checks whether only the 4-color ID units 20Y, 20M, 20C, and 20K are down or not. If only the 4-color ID units 20Y, 20M, 20C, and 20K are down (Yes), it proceeds to S13, and if not all the 4-color ID units 20Y, 20M, 20C, and 20K are down (No), it proceeds to S12.

In S12, only the 4-color ID units 20Y, 20M, 20C, and 20K are moved down and W-color ID unit 20W is up by controlling the up-down mechanisms 30 by the motor controller 86 inside the process controller 70 in FIG. 1 through the photosensitive drum drive motors 96, and it proceeds to S13. In S13, upon confirming that only the 4-color ID units 20Y, 20M, 20C, and 20K are in the down state, the CPU 61 inside the controller control part 60 in FIG. 1 has the density detection patterns 122 formed on the intermediate transfer belt 32 by the control of the process controller 70 in FIG. 1, and it proceeds to S14.

In S14, the belt drive motor 97 is controlled by the motor controller 86 inside the process controller 70 in FIG. 1 to carry the density detection patterns 122 to the position of the density detection part 38 controlled by the image density controller 90 inside the process controller 70. If the density detection patterns 122 have not been carried to the position of the density detection part 38 (No), the carriage is repeated, and if it is detected by the density detection part 38 that the density detection patterns 122 have been carried to that position of the density detection part 38 (Yes), it proceeds to S15.

In S15 the density detection part 38 detects the densities of YMCK in the density detection patterns 122, updates the memory part 100 with the second density detection result that is this density detection result as the second image density IG2, and ends the density detection operation.

Figure 13:
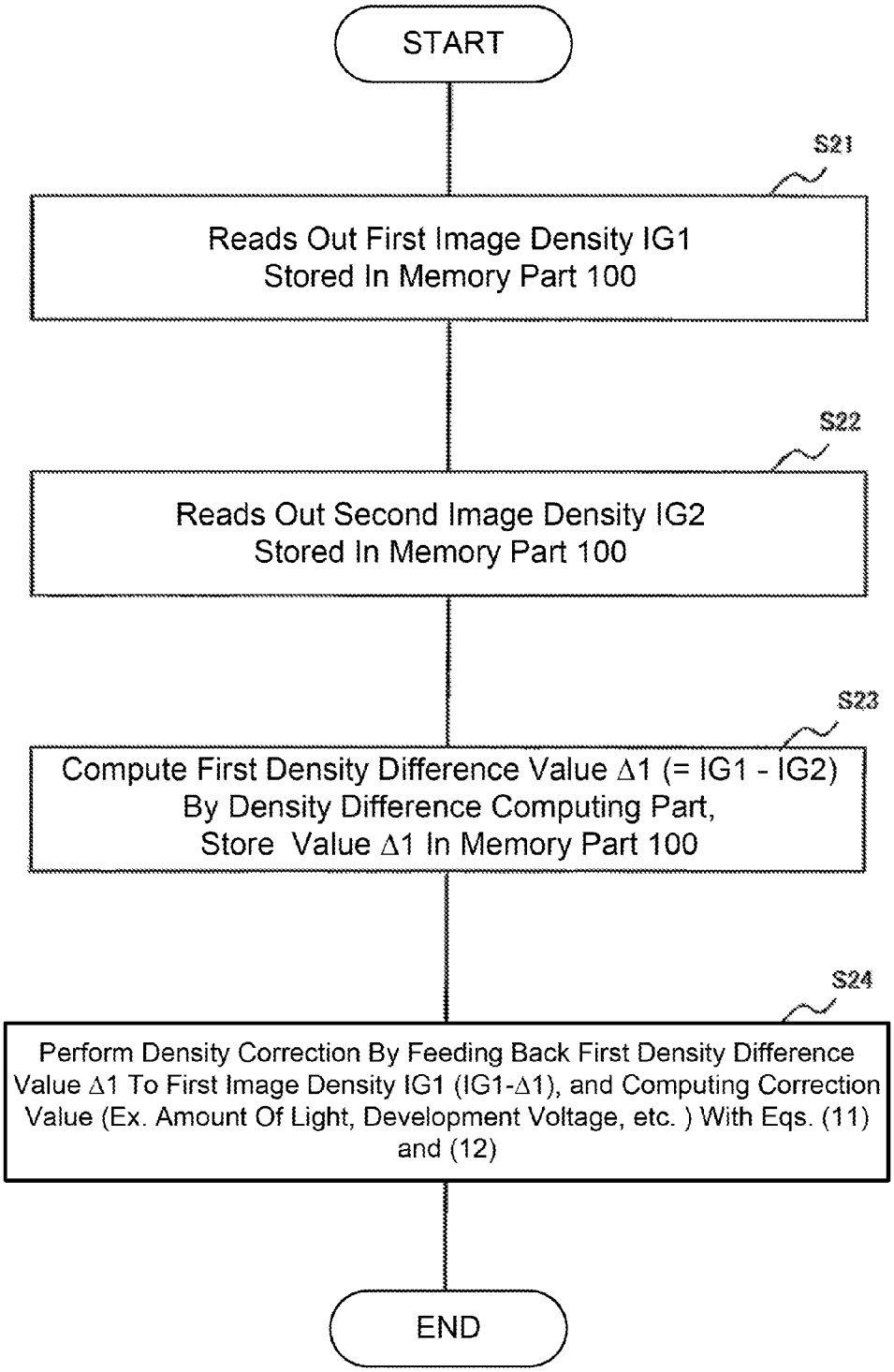
FIG. 13 is a flow chart showing a density correction operation with a first image density IG1 and a second image density IG2.

FIG. 13 is a flow chart showing a density correction operation with the obtained first image density IG1 and second image density IG2.

In FIG. 13, once the density correction operation by the obtained first image density IG1 and second image density IG2 is started, in S21 the process controller 70 in FIG. 1 reads out the first image density IG1 stored in the memory part 100 and proceeds to S22. In S22 the process controller 70 in FIG. 1 reads out the second image density IG2 stored in the memory part 100 and proceeds to S23.

In S23 the density difference computing part 92 inside the image density controller 90 in FIG. 1 computes the first density difference value Δ1 (=First image density IG1−Second image density IG2) that is the density difference between the read-out first image density IG1 and second image density IG2. This first density difference value Δ1 is the influence of the W fog toner 123 in the first state ST1. The process controller 70 stores (or updates) the first density difference value Δ1 in the memory part 100 and proceeds to S24.

In S24 the density correction part 93 inside the image density controller 90 in FIG. 1 substitutes the value (IG1−Δ1) that is obtained by subtracting the first density difference value Δ1 stored in the memory part 100 from the first image density IG1 in the above-mentioned Eqs. (11) and (12) (that is, feeds back the first density difference value Δ1 to the first image density IG1), performs a density correction by computing the correction value, and ends the density correction operation by the first image density IG1 and the second image density IG2.

Figure 14:
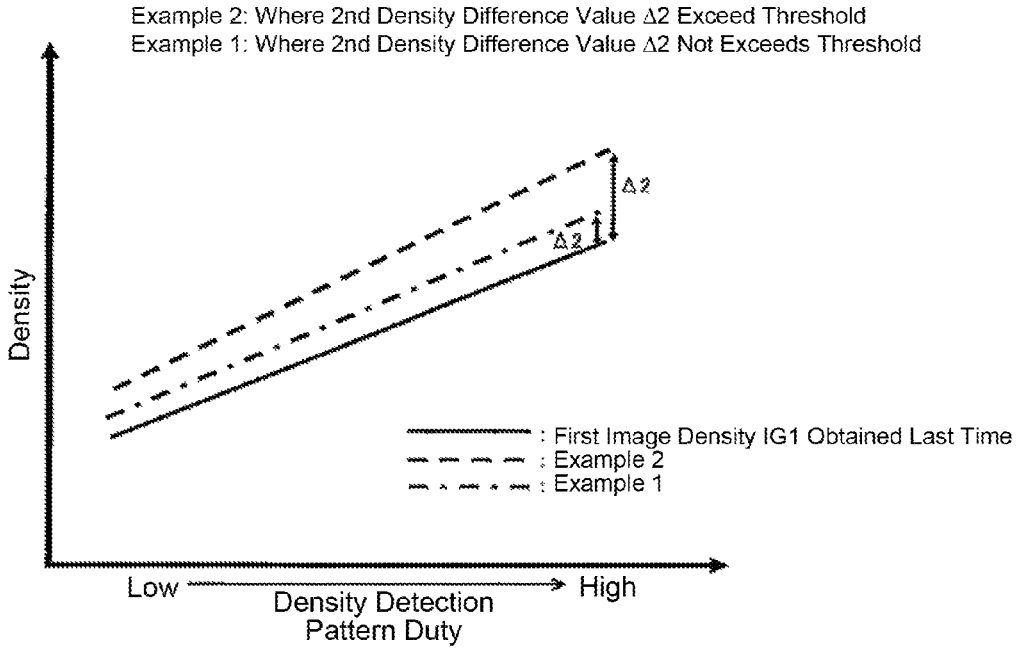
FIG. 14 is a plot illustrating a first image density detection result (for example, a magenta density detection result) that is the image density in the first state ST1 detected by the density detection part 38.

FIG. 14 is a plot illustrating a first image density detection result (for example, an M-color density detection result) that is the image density in the first state ST1 detected by the density detection part 38.

The horizontal axis in FIG. 14 is the density detection pattern duty, and the vertical axis is the density, where the solid line indicates the first image density IG1 that is the first image density detection result obtained last time. The one-dot chain line indicates Example 1 for the case where a second density difference value Δ2 that is the density difference between the first image density IG1 obtained last time and the first image density IG1*a* that is the first image density detection result obtained this time does not exceed a threshold. Further, the broken line indicates Example 2 for the case where the second density difference value Δ2 that is the density difference between the first image density IG1 obtained last time and the first image density IG1*a* obtained this time exceeds the threshold.

Figure 15:
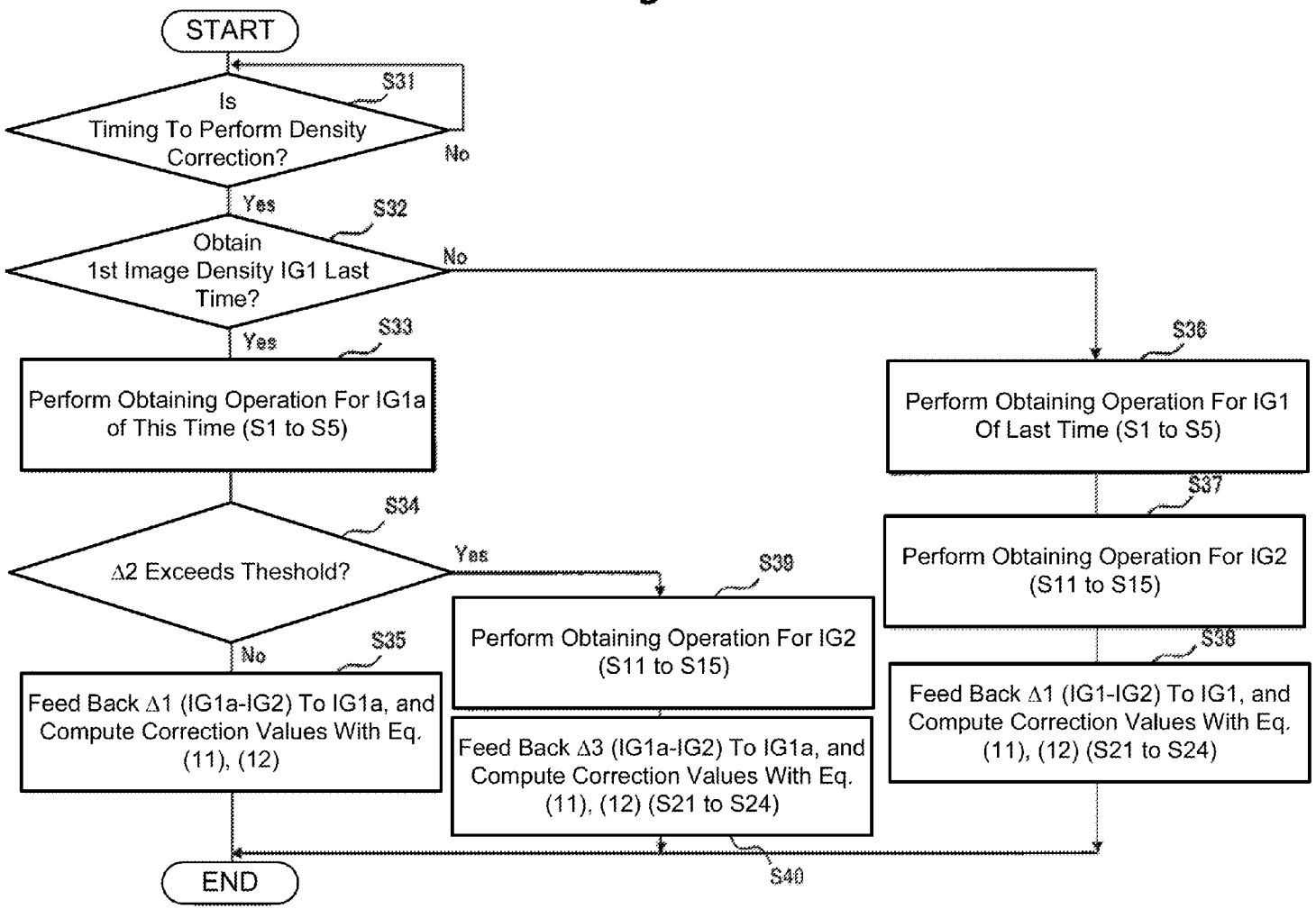
FIG. 15 is a flow chart showing the whole operation of the density correction in FIG. 1.

FIG. 15 is a flow chart showing the whole operation of the density correction in the image forming apparatus 1 in FIG. 1.

The processes in the flow chart in FIG. 15 are explained referring to FIG. 14 etc. Here, the up-down operation and the density detection operation take processing times, and if multiple kinds of density detection operations are performed every time as they were this time, the operation performance of the image forming apparatus 1 would decline. The basic state of the print operation and the density detection operation of the 5-color image forming apparatus 1 is set to the 5-color print mode where all the 5-color ID units 20Y, 20M, 20C, 20K, and 20W are down, and if the first image density IG1 that is the density detection result in this state has significantly changed, such operations as mentioned above are performed.

In the flow chart in FIG. 15, once the whole operation of the density correction is started, in S31 the CPU 61 inside the controller control part 60 in FIG. 1 determines whether it is the timing to perform a density correction or not, and if it is not the timing to perform it (No), it will wait until the timing to perform it. The density correction is preferred at any conditions where the W toner fogs occur. Examples of the conditions are after turning the power supply on, returning from a low power consumption mode, opening/closing the open/close cover 3, replacing the consumables, and printing a specified number of pieces. When the timing to perform a density correction has come (Yes), it proceeds to S32.

In S32 the image density detection determination part 94 inside the image density controller 90 in FIG. 1 checks from the memory content of the memory part 100 whether the first image density IG1 was obtained last time (that is, whether a density detection was performed in the first state ST1 where all the 5-color ID units 20Y, 20M, 20C, 20K, and 20W are down), and if the first image density IG1 was obtained last time (Yes), it proceeds to S33, and if not obtained (No), proceeds to S36.

In S33, an obtaining operation for the first image density IG1*a* of this time (that is, the processes in S1 through S5 in FIG. 11) is performed, and it proceeds to S34. In S34 the density difference computing part 92 inside the image density controller 90 in FIG. 1 computes the second density difference value Δ2 (=|IG1−IG1*a*|) that is the density difference between the first image density IG1 of the last time stored in the memory part 100 and the first image density IG1*a* obtained this time. As shown in FIG. 14, the image density determination part 95 compares the computed second density difference value Δ2 and a specified threshold to determine whether the second density difference value Δ2 exceeds the specified threshold or not. Example 1 in FIG. 14 is the case where the second density difference value Δ2 does not exceed the specified threshold, and Example 2 is the case where it exceeds the specified threshold. If the second density difference value Δ2 exceeds the specified threshold (Yes), it proceeds to S39, and if it does not exceed it (No), proceeds to S35. Herein, the specified threshold is a design value that is determined below which no influence of fogs appear (or no fog occurs) in the bases of experiences.

In S35 the density correction part 93 inside the image density controller 90 in FIG. 1 substitutes the value (=IG1*a*−Δ1) that is obtained by subtracting the first density difference value Δ1 computed by the density difference computing part 92 last time from the first image density IG1*a* computed by the density difference computing part 92 this time in the above-mentioned Eqs. (11) and (12) (that is, feeds back the first density difference value Δ1 to the first image density IG1*a*), computes correction values (for example, the light amount, the development voltage, etc.), performs a density correction, and ends the whole operation of the density correction.

In S36, in the same manner as in S33, an obtaining operation for the first image density IG1 (that is, the processes in S1 through S5 in FIG. 11) is performed, and it proceeds to S37. In S37, an obtaining operation for the second image density IG2 (that is, the processes in S11 through S15 in FIG. 12) is performed, and it proceeds to S38. In S38, a density correction with the obtained first image density IG1 and second image density IG2 is performed. That is, in S38, in the same manner as in the processes in S21 through S24 in FIG. 13, the first density difference value Δ1 (=IG1−IG2) that is the density difference between the first image density IG1 and the second image density IG2 is obtained, and this first density difference value Δ1 is fed back to the first image density IG1 (IG1−Δ1), a density correction is performed by computing the correction values (for example, the amount of light and the development voltage) from the above-mentioned Eqs. (11) and (12), and the whole operation of the density correction ends.

In S39, in the same manner as in S37, an obtaining operation for the second image density IG2 (that is, the processes in S11 through S15 in FIG. 12) is performed, and it proceeds to S40. In S40, in about the same manner as in S38, a density correction with the obtained first image density IG1*a* and second image density IG2 of this time is performed. That is, in S40, in about the same manner as in the processes in S21 through S24 in FIG. 13, a third density difference value Δ3 (=IG1*a*−IG2) that is the density difference between the first image density IG1*a* and the second image density IG2 of this time is obtained, and this third density difference value Δ3 is fed back to the first image density IG1*a* (IG1*a*−Δ3), a density correction is performed by computing the correction values (for example, the light amount and the development voltage) from the above-mentioned Eqs. (11) and (12), and the whole operation of the density correction ends.

Efficacy of Embodiment 1

According to this Embodiment 1, in a 5-color image forming apparatus 1 dealing with YMCK colors and a special color W, the results of performing density detections in multiple states of the first state ST1 where all the YMCKW colors are down and the second state ST2 where only the YMCK are down are fed back to the density correction. Thereby, an appropriate color density correction can be realized without being influenced by the W fog toner 123 that easily develops fog.

MODIFICATIONS

This invention is not limited to the above-mentioned Embodiment 1 but allows various kinds of utilization forms and modifications. Examples of these utilization forms and modifications are the following (a) through (e).

(a) Although the position where the W-color ID unit 20W is disposed was set to the most downstream in the carrying direction X of the intermediate transfer belt 32, it may be disposed in any of the multiple stations 10Y through 10W. Also, the order and the number of the array of stations 10Y through 10W are not limited to those in Embodiment 1.

(b) Although the W fog toner 123 was explained as the second toner containing a large amount of metal oxides having a low resistance, this invention can be applied to other toners such as gold and silver that easily fog.

(c) Although explained as an example was a case where, in the image forming apparatus 1 using an intermediate transfer system that transfers toner images to an intermediate transfer body (for example, the intermediate transfer belt 32) and afterwards transfers the toner images to the print medium 4, the density detection patterns 121 and 122 are transferred to the intermediate transfer belt 32, this invention is not limited to this. For example, the density detection patterns 121 and 122 may be transferred onto the print medium 4 such as a sheet of paper carried by the intermediate transfer belt 32. Also, the intermediate transfer body may be an intermediate drum etc. other than the intermediate transfer belt 32.

(d) Although the explanation was given on the image forming apparatus 1 using an intermediate transfer system, this invention can also be applied to an image forming apparatus using a direct transfer system that directly transfers toner images to the print medium 4. In this case, the transfer medium, to which the density detection patterns 121 and 122 are transferred, is either a transfer belt, a transfer roller, or the like that directly transfers toner images, or the print medium 4 carried by the transfer belt, the transfer roller, or the like, and the density correction is performed by detecting the densities of the density detection patterns 121 and 122 transferred onto that transfer medium.

(e) Although explained as the image forming apparatus 1 was an example of a color electrophotographic printer, this invention can also be applied to facsimile machines, copiers, multifunction printers (MFPs), etc.

In the above-mentioned embodiments, the embodiments based on the first, second, and third density difference values ($\Delta 1$ to $\Delta 3$) obtained based on the differences of two densities were explained According to this invention, there is no need to be limited to the density differences. It can also be embodied based on the ratios of two densities. In that case, the embodiments can be based on the first, second, and third density ratio values. As their generic concept, it can be said that this invention can be embodied based on density comparison values. Further, a first density comparison value of the invention includes the first density difference value and the first density ratio. A second density comparison value includes the second density difference value and the second density ratio. A third density comparison value includes the third density difference value and the third density ratio.

What is claimed is:

1. An image forming apparatus, comprising:

a first image forming unit that forms a first developer image with a first developer, a second image forming unit that forms a second developer image with a second developer that contains a larger amount of metal oxides having a low resistance than the first developer contains, a transfer part that contacts with the first image forming unit and the second image forming unit and transfers the first developer image and the second developer image to a transfer medium, a disjunction mechanism that moves the second image forming unit to realize a first state and a second state, the first state where both the first image forming unit and the second image forming unit contact with the transfer part and the second state where the second image forming unit separates from the transfer part and the first image forming unit contacts with the transfer part, a density detection part that detects densities of the first developer image and the second developer image transferred to the transfer medium, and a control part that controls operations of the first image forming unit, the second image forming unit, the transfer part, the disjunction mechanism, and the density detection part, wherein the control part controls an operation of the density detection part to cause the density detection part to detect a first density of the first developer image among the first developer image and the second developer image transferred to the transfer medium in the first state to obtain a first density detection result, and to detect a second density of the first developer image transferred to the transfer medium in the second state to obtain a second density detection result that is the density detection result, and afterwards computes a first density comparison value obtained by comparing the first density detection result with the second density detection result and corrects the density of the first developer image by subtracting the first density comparison value from the first density detection result.

2. The image forming apparatus according to claim 1, wherein the control part comprises:

a density detection operation control part that controls the operation of the density detection part to causes the density detection part to obtain the first density detection result and the second density detection result, a density difference computing part that computes the first density comparison value of the first density detection result and the second density detection result, and a density correction part that obtains a correction value by subtracting the first density comparison value from the first density detection result and corrects the density of the first developer image using the correction value.

3. The image forming apparatus according to claim 1, further comprising:

a memory part that is controlled by the control part to store the first density detection result, the second density detection result, and the first density comparison value.

4. The image forming apparatus according to claim 1, wherein the control part comprises a first determination part that determines whether the first density detection result of the last time, which was obtained by the most recently performed operation by the control part, was obtained or not, and if the first determination part determines that the first density detection result of the last time was not obtained, the control part controls the operation of the density detection part to cause the density detection part to obtain the first density detection result of this time, which is obtained by the currently performed operation by the control part, and the second density detection result, afterwards computes the first density comparison value of the first density detection result and the second density detection result, and corrects the density of the first developer image by subtracting the first density comparison value from the first density detection result.

5. The image forming apparatus according to claim 4, wherein the control part comprises a second determination part that determines whether a second density comparison value that is a density difference between the first density detection result of the last time and the first density detection result of this time exceeds a specified threshold or not, if the first determination part determines that the first density detection result of the last time was obtained, the control part controls the operation of the density detection part to cause the density detection part to obtain the first density detection result of this time, afterwards computes the second density comparison value that is the density difference between the first density detection result of the last time and the first density detection result of this time, if the second determination part determines that the second density comparison value exceeds the specified threshold, the control part controls the operation of the density detection part to cause the density detection part to obtain the second density detection result, afterwards computes a third density comparison value that is a density difference between the first density detection result of this time and the second density detection result, and corrects the density of the first developer image transferred to the transfer medium by subtracting the third density comparison value from the first density detection result of this time, and if the second determination part determines that the second density comparison value does not exceed the specified threshold, the control part corrects the density of the first developer image of this time, which is obtained by the currently performed operation, transferred to the transfer medium by subtracting another first density comparison value that is a density difference between the first density detection result of the last time and the second density detection result of the last time, which was obtained by the most recently performed operation, from the first density detection result of this time.

6. The image forming apparatus according to claim 1, wherein the first developer is a developer used in both a 4-color mode and a 5-color special-color mode, and the second developer is a developer used only in the 5-color special-color mode.

7. The image forming apparatus according to claim 1, wherein each of the first image forming unit and the second image forming unit comprises a charging part that charges an image carrier, an exposure part that writes an electrostatic latent image on the charged image carrier, and a development part that visualizes the electrostatic latent image by attaching either the first developer or the second developer to the electrostatic latent image.

8. The image forming apparatus according to claim 7, wherein the first developer image and the second developer image are density detection patterns, the transfer part transfers and prints the density detection patterns onto the transfer medium and, the density detection part detects the densities of the density detection patterns printed on the transfer medium.

9. The image forming apparatus according to claim 8, wherein the density detection patterns comprise multiple patterns of different densities.

10. The image forming apparatus according to claim 8, wherein the transfer medium is one of an intermediate transfer belt that indirectly transfers image data to a print medium, a transfer belt from which the image data are directly transferred to the print medium, or the print medium.

11. The image forming apparatus according to claim 1, wherein the second developer includes a white-color developer.

* * * * *